United States Patent [19]

Pepple

[11] 4,349,081

[45] Sep. 14, 1982

[54] METHOD FOR RETAINING A HEARING AID IN PLACE AND HEARING AID HARNESS

[76] Inventor: Audrey Pepple, R.D. 1, Box 472, East Freedom, Pa. 16637

[21] Appl. No.: 214,110

[22] Filed: Dec. 8, 1980

[51] Int. Cl.[3] ..... H04R 25/00

[52] U.S. Cl. ..... 181/130

[58] Field of Search ..... 181/129, 130, 135; 179/107 R, 107 E, 156 R; 2/423

[56] References Cited

U.S. PATENT DOCUMENTS

| | | | |
|---|---|---|---|
| 1,329,029 | 1/1920 | Timmons . | |
| 1,354,524 | 10/1920 | Timmons . | |
| 2,460,458 | 2/1949 | Kobrin | 179/156 |
| 2,624,051 | 1/1953 | Motley . | |
| 2,998,497 | 8/1961 | May | 179/156 |
| 3,087,028 | 4/1963 | Bonnin | 179/156 |
| 3,327,807 | 6/1967 | Mullin | 181/129 |
| 3,541,611 | 11/1970 | Beguin | 2/423 X |

FOREIGN PATENT DOCUMENTS

| | | | |
|---|---|---|---|
| 883002 | 9/1951 | Fed. Rep. of Germany | 179/156 |

*Primary Examiner*—Richard A. Wintercorn
*Assistant Examiner*—Thomas H. Tarcza
*Attorney, Agent, or Firm*—Buell, Blenko, Ziesenheim & Beck

[57] ABSTRACT

A method for retaining a hearing aid in place on a person includes providing a harness having a plurality of transverse straps, a connecting longitudinal strap, a chip strap and at least one ear cover. The hearing aid is positioned within or adjacent to the person's ear or ears and the harness is placed over the head with the ear cover or covers overlying the hearing aid or aids. The chin strap is secured so as to urge the ear cover or covers into intimate overlying relationship with the hearing aid or hearing aids so as to resist undesired movement of the hearing aid out of the desired position. The hearing aid harness preferably has a plurality of transverse strap members and a connecting longitudinal strap member which are adapted to assumed relative spaced positions on the head of the user. One or more ear covers are provided and a chin strap which is preferably adjustable serves to secure the assembly on the user's head with the ear covers in intimate relationship with the hearing aids.

13 Claims, 5 Drawing Figures

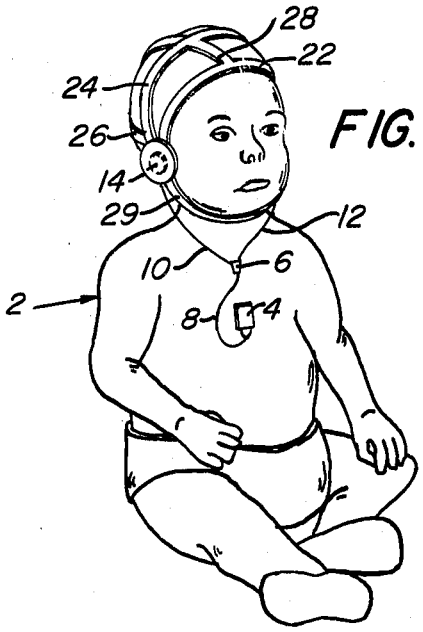
FIG. 1
FIG. 2
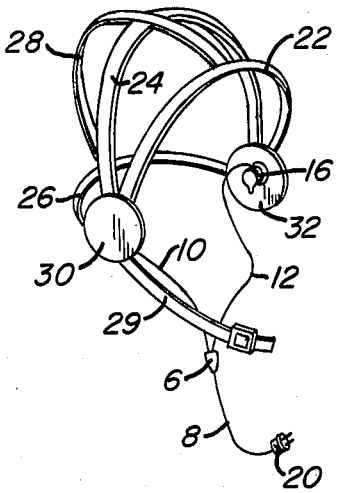
FIG. 4
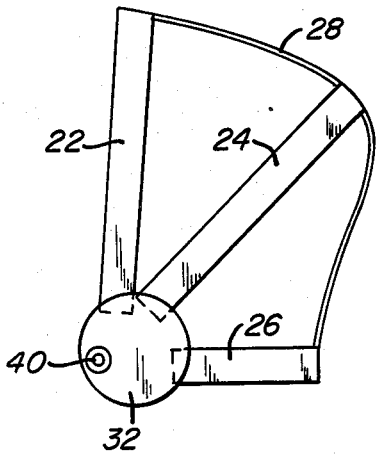
FIG. 3
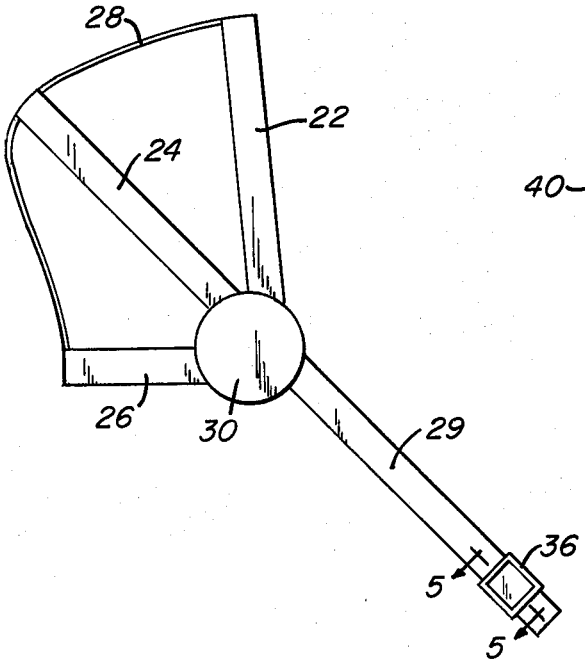
FIG. 5
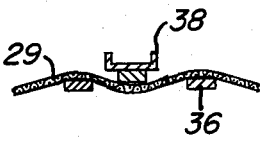

METHOD FOR RETAINING A HEARING AID IN PLACE AND HEARING AID HARNESS

BACKGROUND OF THE INVENTION

1. Field of the Invention

This invention relates to a method of securing a hearing aid in place and to a harness for use in accomplishing such retention.

2. Description of the Prior Art

It has been known for years to use various forms of electrically energized hearing aids in one or both ears of people who have hearing difficulties in order to facilitate improvement in their natural hearing abilities. Over the years numerous improvements have been made in respect of technical efficiency of such devices, as well as reduction in size and ease with which the users might make the physical and psychological adjustment required to obtain maximum benefit from such devices.

With respect to use of such devices on infants and other young children, numerous problems have been encountered. As the patient is frequently not of sufficient age to be instructed in the importance of retaining the hearing aid or aids in proper position or may be of such an age to comprehend but not obey, it is frequently difficult to maintain the hearing aid in the desired position even through such positioning may be critical to obtaining much needed improved hearing on the part of the infant or young child.

It has been known to maintain such hearing aids in position by taping them to the ear. This has created problems as children will frequently remove the adhesive tape and the hearing aid. Also, repeated use of such tape frequently creates skin problems, such as rashes and other irritations, and removal of the tape when necessary can be somewhat painful.

It has also been known to provide hats which serve to resist removal of the hearing aids. Such hats tend to be very uncomfortable when worn over a prolonged period of time and are frequently removed by the children. Also, in hot and humid weather, excessive perspiration occurs resulting in discomfort and frequently, illness.

U.S. Pat. No. 3,327,807 discloses a substantially rigid unitary headband which is adapted to be positioned across the top of the user's head. A hearing aid is secured to one or both ends of the band. While such a headset might be functional with an older child or an adult, it lacks the desired retention power required for use with an infant or younger child.

There remains, therefore, a substantial need for an effective means of securing one or more hearing aids in the desired position, particularly with respect to infants and young children.

SUMMARY OF THE INVENTION

The present invention has met the above-described need by providing a unique form of harness construction which is adapted to be positioned in such fashion as to provide ear covers urging the hearing aid into the desired position. The harness has a plurality of transverse straps, a longitudinal strap, one or more ear covers and a chin strap which is preferably adjustable. After positioning the harness with the ear cover or covers over the ear or ears, the chin strap is secured so as to provide for the desired intimate relationship.

It is an object of the present invention to provide an improved method and apparatus for retaining effectively one or more hearing aids in the desired intimate relationship with the user's ear.

It is another object of this invention to provide such a method and apparatus which is simple to manufacture, economical to use and does not require the use of skilled personnel.

It is another object of the present invention to provide such a method and apparatus which involves minimum discomfort to the user or patient.

It is yet another object of the present invention to provide such a harness which is lightweight so as not to be burdensome on the user.

These and other objects of the invention will be more fully understood from the following description of the invention on reference to the illustrations appended hereto.

BRIEF DESCRIPTION OF THE DRAWINGS

FIG. 1 is a partially schematic illustration of a child wearing a form of apparatus of the present invention.

FIG. 2 is a partially schematic illustration of a form of harness usable in the present invention.

FIG. 3 is a right-side elevation of the harness shown in FIG. 2.

FIG. 4 is a left-side elevation of the harness shown in FIG. 2.

FIG. 5 is a fragmentary cross sectional illustration of a portion of the chin strap shown in FIG. 3, taken through 5—5.

DESCRIPTION OF THE PREFERRED EMBODIMENTS

As used herein the term "child" shall refer to an infant or a child under the age of six years.

Referring now in greater detail to FIGS. 1 and 2, there is shown a child 2 wearing hearing aids on both ears. In the form illustrated, the hearing aid consists of a body style hearing aid box 4 which is connected electrically to a coupler 6 by wire 8. Wires 10, 12 carry the signal to hearing aid receiver button 14 and hearing aid receiver button 16 which are inserted in the ear canals or positioned adjacent to the ear. In this fashion, sounds picked up by hearing aid box 4 will be transmitted to the ears of the child 2.

The harness includes a plurality of transverse straps 22, 24 26 which, in the form shown, have an ear cover 30 secured at or adjacent one series of ends thereof and an ear cover 32 at or adjacent the other series of ends thereof. In the form shown, a chin strap 29 has one end portion secured to ear cover 30 and the other end portion adapted to be secured to ear cover 32.

It will be appreciated, that while for convenience of reference herein, reference will be made to the use of a method and apparatus for securing two hearing aids to the user, if desired, the harness may be employed with a single hearing aid, in which case, one of the ear covers 30, 32 may be deleted, if desired. Where one ear cover 30, 32 is deleted, the straps 22, 24, 26, 29 may be secured to each other directly or to one or more connector members on the side where the ear cover does not exist.

In use, the hearing aid receiver buttons 14, 16 will be placed in the ear canals and then the harness will be placed over the head, preferably with strap 22 being on top of the head, strap 26 being at the rear of the head or neck and strap 24 remaining spaced therebetween. It will be appreciated that the longitudinal strap 28 establishes the maximum spacing between straps 22 and 26. The ear covers 30, 32 will be placed over the ears so as to retain the hearing aid receiver buttons 14, 16 in the desired position. Adjustable chin strap means 29 will then be so secured so as to urge the ear covers 30, 32 into intimate relationships with hearing aid receiver buttons 14, 16.

It is preferred that the strap members 22, 24, 26, 28 and ear covers 30, 32 as well as strap 29, be composed of a natural or synthetic fabric material. It is preferred that these strap members 22, 24, 26, 28 and ear covers 30, 32 be relatively flexible and nonextensible so as to preserve the desired intimacy of contact between the ear covers 30, 32 and the hearing aid receiver buttons 14, 16. It is also preferred that these portions of the harness be made of a material which is porous and permits the flow of air therethrough, but is electrically and magnetically generally nonconductive so as not to interfere with the efficiency and performance of the hearing aids. Among the preferred materials for manufacture of the harness are cotton, polyester, nylon, lightweight denim, cotton-rayon blends, cotton-polyester blends and grosgrain.

Referring now in greater detail to FIGS. 3 and 4, it will be appreciated that strap 22 is oriented substantially perpendicularly with respect to strap 26 and strap 24 is oriented generally angularly midway therebetween. The ear covers 30, 32, while in the form shown are shown as being generally circular may have any desired configuration. It is preferred, however, that they be of sufficient size as to cover substantially the entire ear of the user. A preferred dimension for the ear covers is that they have a minimum width or diameter of about $1\frac{1}{2}$ to 3 inches. It is preferred that the straps 22, 24, 26, 28, 29 have a width of about $\frac{1}{2}$ to $\frac{3}{4}$ inch.

Referring now to FIGS. 3, 4 and 5, it will be seen that through buckle 36 and establishing relative movement thereof with strap 29, the effective length of strap 29 may be adjusted. Once the desired length has been obtained, male snap member 38 which is mounted on buckle 36 is secured to female snap member 40 which is mounted on the exterior of ear cover 32. Obviously, if desired, the male and female portions of the snap may be reversed or other fastening means may be employed.

An alternate means of providing the desired adjustability in length of the chin strap would be to provide a snap in a fixed position on the strap 29, but to have all or a portion of the strap 29 made from a resiliently expandable material.

While the ear covers 30, 32 may generally each consist of a pair of circular pieces of material between which the ends of the straps 22, 24, 26, 29 are secured and which are secured to each other as by sewing, if desired, a compressible resilient cushioning material such as a sponge or a foam plastic may be employed to provide a cushioning effect. Such material may be placed on the inside surface of the ear cover 30, 32 or between a pair of pieces of material which are joined to form the ear cover, for example.

It will be appreciated, therefore, that the method and apparatus of the present invention provides an economical means of securing one or more hearing aids in intimate high efficiency position with respect to the ear of the patient or user. All of this is accomplished in a fashion which minimizes patient discomfort, as well as minimizing the likelihood of skin or other diseases or illnesses resulting from the retaining method or device. The method and device are particularly advantageous in respect of use with infants or young children.

While for purposes of simplicity of illustration, the best mode of practicing the invention has been disclosed, it will be apparent to those skilled in the art that changes may be made without departing from the invention. For example, the chin strap may be made of a fixed length and one of the other straps may be of adjustable length, so as to provide the desired intimacy of relationship. Also, while a device employing three transverse straps has been illustrated, it will be appreciated that a harness employing two transverse straps or greater than three transverse straps may be employed.

Whereas, particular embodiments of the invention have been described above for purposes of illustration, it will be evident to those skilled in the art, that numerous variations of the details may be made without departing from the invention as defined in the appended claims.

I claim:

1. A method of retaining a hearing aid in place on a child comprising providing a harness having a plurality of transverse straps, a longitudinal strap, a chin strap and at least one ear cover, positioning an electrically energized hearing aid member within or adjacent to one of said child's ears, positioning said harness on said child's head with said ear cover overlying and contacting said hearing aid member, said ear cover being flexible, providing said transverse straps of a natural or synthetic fiber material, and securing said chin strap to urge said ear cover into intimate relationship with said hearing aid member to resist undesired movement of said hearing aid member out of the desired position, whereby said hearing aid member will be retained in the desired position with respect to said child's ear and the child may lie down without having its head supported by and receiving discomfort from a rigid portion of said harness.

2. The method of retaining a hearing aid in place of claim 1 including providing means for adjusting the length of said chin strap, and adjusting said chin strap length so as to provide for intimate relationship between said ear cover and said hearing aid member when said chin strap is secure.

3. The method of retaining a hearing aid in place of claim 1 including providing said harness with two said ear covers, and inserting a said hearing aid member within or adjacent to each said ear.

4. The method of retaining a hearing aid in place of claim 3 including providing said ear covers of sufficient size so as to substantially completely cover said ears, and providing said ear covers of a generally porous material which permits flow of air therethrough.

5. The method of retaining a hearing aid in place of claim 1 including positioning a first said transverse strap over the top of the person's head, positioning a second said transverse strap across the rear of the head or neck of said person, positioning a third said transverse strap intermediate said first and second straps, and positioning said chin strap over the front of the neck.

6. A hearing aid retainer harness for a child comprising a plurality of transverse strap members, a longitudinal step member secured to at least some of said transverse strap members, at least one ear cover secured to said transverse strap members, said transverse straps, longitudinal strap and ear cover made of natural or synthetic fiber material, said ear cover being composed of a flexible material which is generally porous to air and is electrically and magnetically generally nonconductive, said harness being of such size as to fit a child, and chin strap means for securing said harness to a child's head with said ear cover in intimate hearing aid retaining positioning.

7. The hearing aid retainer harness of claim 6 including said harness having two said ear covers, and opposed end portions of said transverse straps secured to said ear pieces.

8. The hearing aid retainer harness of claim 7 including said chin strap means being of adjustable length.

9. The hearing aid retainer harness of claim 8 including said chin strap means having one end portion secured to an ear cover and a second end portion adapted to be secured to the other said ear cover.

10. The hearing aid retainer harness of claim 7 including said straps having a width of about $\frac{1}{2}$ to $\frac{3}{4}$ inch.

11. The hearing aid retainer harness of claim 7 including said ear cover having a minimum width of about $1\frac{1}{2}$ to 3 inches.

12. The hearing aid retainer harness of claim 7 including a first said transverse strap oriented generally perpendicularly with respect to a second said transverse strap, and a third said transverse strap interposed between said first and second transverse straps.

13. The hearing aid retainer harness of claim 8 including adjustable buckle means secured to said chin strap, and said buckle means having a snap member cooperating with a second snap member secured on one of said ear covers to facilitate adjustment and securement of said chin strap.

* * * * *

UNITED STATES PATENT AND TRADEMARK OFFICE

CERTIFICATE OF CORRECTION

PATENT NO. : 4,349,081

DATED : September 14, 1982

INVENTOR(S) : AUDREY PEPPLE

It is certified that error appears in the above-identified patent and that said Letters Patent are hereby corrected as shown below:

Claim 6, column 5, line 4, "step" should be --strap--.

Claim 6, column 5, line 9, after "of" --a-- should be inserted.

Signed and Sealed this

*Fifteenth* Day of *February 1983*

[SEAL]

*Attest:*

GERALD J. MOSSINGHOFF

*Attesting Officer*

*Commissioner of Patents and Trademarks*